US012753943B2

(12) United States Patent
Fukushima et al.

(10) Patent No.: US 12,753,943 B2
(45) Date of Patent: Oct. 6, 2026

(54) CONTROL DEVICE AND AIR CONDITIONER

(71) Applicant: DAIKIN INDUSTRIES, LTD., Osaka (JP)

(72) Inventors: Teruhisa Fukushima, Osaka (JP); Kazuhei Yamada, Osaka (JP); Narushige Ueda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 82 days.

(21) Appl. No.: 18/584,042

(22) Filed: Feb. 22, 2024

(65) Prior Publication Data

US 2024/0191904 A1 Jun. 13, 2024

Related U.S. Application Data

(63) Continuation of application No. PCT/JP2022/039239, filed on Oct. 21, 2022.

(30) Foreign Application Priority Data

Oct. 22, 2021 (JP) ..... 2021-172869

(51) Int. Cl.
*F24F 11/88* (2018.01)
*F24F 11/89* (2018.01)

(52) U.S. Cl.
CPC ..... *F24F 11/88* (2018.01); *F24F 11/89* (2018.01)

(58) Field of Classification Search
CPC ..... F24F 11/88; F24F 11/89
See application file for complete search history.

(56) References Cited

U.S. PATENT DOCUMENTS 6,727,952 B1 * 4/2004 Hirata ..... G03B 7/26 396/303
2009/0178424 A1 7/2009 Hwang et al.
2011/0167861 A1 7/2011 Yamamoto et al.
(Continued)

FOREIGN PATENT DOCUMENTS

EP 3 933 290 A1 1/2022
JP 11-257690 A 9/1999
JP 2001-41530 A 2/2001
(Continued)

OTHER PUBLICATIONS

Okuyama et al., Air Conditioner, Dec. 15, 2016, JP2016211779A, Whole Document (Year: 2016).*
(Continued)

*Primary Examiner* — Larry L Furdge
(74) *Attorney, Agent, or Firm* — Birch, Stewart, Kolasch & Birch, LLP

(57) ABSTRACT

A control device includes a first control board connected with an AC power source and equipped with a first control unit, and a second control board provided separately and different from the first control board and equipped with a second control unit. The first control board includes a noise filter, an AC-DC converter configured to generate DC voltage from AC voltage, and DC output wiring configured to allow the DC voltage to be used in the board and also supply the DC voltage to outside the board. The second control board is supplied with DC voltage from the DC output wiring.

15 Claims, 10 Drawing Sheets

(56) References Cited

U.S. PATENT DOCUMENTS

| | | | | |
|---|---|---|---|---|
| 2014/0097697 | A1* | 4/2014 | Cho | G06F 1/26 307/104 |
| 2018/0054089 | A1* | 2/2018 | Lee | G09G 5/006 |

FOREIGN PATENT DOCUMENTS

| | | | | |
|---|---|---|---|---|
| JP | 2002-89898 | A | | 3/2002 |
| JP | 2003-322389 | A | | 11/2003 |
| JP | 2010-98726 | A | | 4/2010 |
| JP | 2016211779 | A | * | 12/2016 |
| WO | WO 2020/174563 | A1 | | 9/2020 |
| WO | WO 2021/148949 | A1 | | 7/2021 |

OTHER PUBLICATIONS

Yamakaji et al., Electrical Device and Air Conditioner, Sep. 3, 2020, WO2020174563A1, Whole Document (Year: 2020).*

Extended European Search Report for European Application No. 22883661.5, dated Nov. 22, 2024.

International Preliminary Report on Patentability and Written Opinion of the International Searching Authority for International Application No. PCT/JP2022/039239, dated Apr. 23, 2024.

International Search Report for PCT/JP2022/039239 (PCT/ISA/210) mailed on Jan. 10, 2023.

* cited by examiner

CONTROL DEVICE AND AIR CONDITIONER

CROSS REFERENCE TO RELATED APPLICATIONS

This application is a Continuation of PCT International Application No. PCT/JP2022/039239, filed on Oct. 21, 2022, which claims priority under 35 U.S.C. 119 (a) to Patent Application No. 2021-172869, filed in Japan on Oct. 22, 2021, all of which are hereby expressly incorporated by reference into the present application.

TECHNICAL FIELD

The present disclosure relates to a control device, and an air conditioner including the control device.

BACKGROUND ART

An air conditioner includes an outdoor unit and an indoor unit each of which typically has a control board equipped with a microcomputer (see PATENT LITERATURE 1 or the like). The microcomputers on the two control boards are connected via a transmission line, so as to communicate with each other. Along with advanced functionality of air conditioners in recent years, a single outdoor unit may be provided with a plurality of control boards.

CITATION LIST

Patent Literature

PATENT LITERATURE 1: Japanese Laid-Open Patent Publication No. 2001-41530

SUMMARY OF THE INVENTION

Technical Problem

Provision of the plurality of control boards needs a power source circuit for delivery of DC voltage necessary on each of the boards from an external commercial AC power source. This increases the total number of components necessary for the power source circuit.

In view of this, it is an object of the present disclosure to reduce the number of components even in a case where a single apparatus is equipped with a plurality of control boards.

Solution to Problem (1) The present disclosure provides a control device including: a first control board connected with an AC power source and equipped with a first control unit; and a second control board provided separately and different from the first control board and equipped with a second control unit; in which the first control board includes a noise filter, an AC-DC converter configured to generate DC voltage from AC voltage, and DC output wiring configured to allow the DC voltage to be used in the board and also supply the DC voltage to outside the board, and the second control board is supplied with the DC voltage from the DC output wiring.

In the control device thus configured, the second control board needs neither a noise filter nor an AC-DC converter, so as to achieve reduction in the number of components relevant to a power source circuit. Accordingly, the number of components can be reduced even in a case where a single apparatus is equipped with a plurality of control boards.

(2) In the control device according to (1) described above, the first control board and the second control board are preferably accommodated in a common case.

In this case, it is possible to inhibit noise generated on a communication circuit configured to execute communication between the first control unit and the second control unit.

(3) In the control device according to (1) or (2) described above, for example, the second control board includes a communication circuit configured to execute communication between the first control unit and the second control unit by means of a current signal, and the communication circuit includes an input unit configured to provide an input signal from the first control board to the second control unit, an output unit connected in series to the input unit and configured to output an output signal from the second control unit to the first control board, and a bypass circuit provided in parallel with the output unit and including a first switch, and the second control unit closes the first switch when coming into a sleep mode and opens the first switch when cancelling the sleep mode.

In this case, the bypass circuit is formed to keep the communication circuit by means of a current signal even in a case where there is another control board provided for an additional function and configured similarly to the second control board.

(4) In the control device according to (3) described above, the first switch is a semiconductor switch or the like, and resistance is connected in series on a positive potential side from a control terminal.

This case enables inhibition of control current flowing to the semiconductor switch.

(5) In the control device according to (3) or (4) described above, when the first switch is closed, electric resistance is less than electric resistance of the output unit.

Electric current can reliably flow to the bypass circuit in this case.

(6) In the control device according to any one of (1) to (5) described above, the second control unit exemplarily controls a function of ventilation, humidification, or washing.

Such a function can be achieved by the second control unit independently from the first control unit.

(7) In the control device according to any one of (1) to (6) described above, optionally, the second control board includes a switching power source to be supplied with the DC voltage, and the switching power source has an output side provided with a second switch.

When the second control unit comes into the sleep mode, the second control board opens the second switch so as to inhibit power consumption.

(8) An air conditioner includes the control device according to any one of (1) to (7) described above.

DETAILED DESCRIPTION

Description will be made hereinafter to an embodiment of the present disclosure with reference to the drawings.

Outer Appearance Configuration of Air Conditioner

Figure 1:
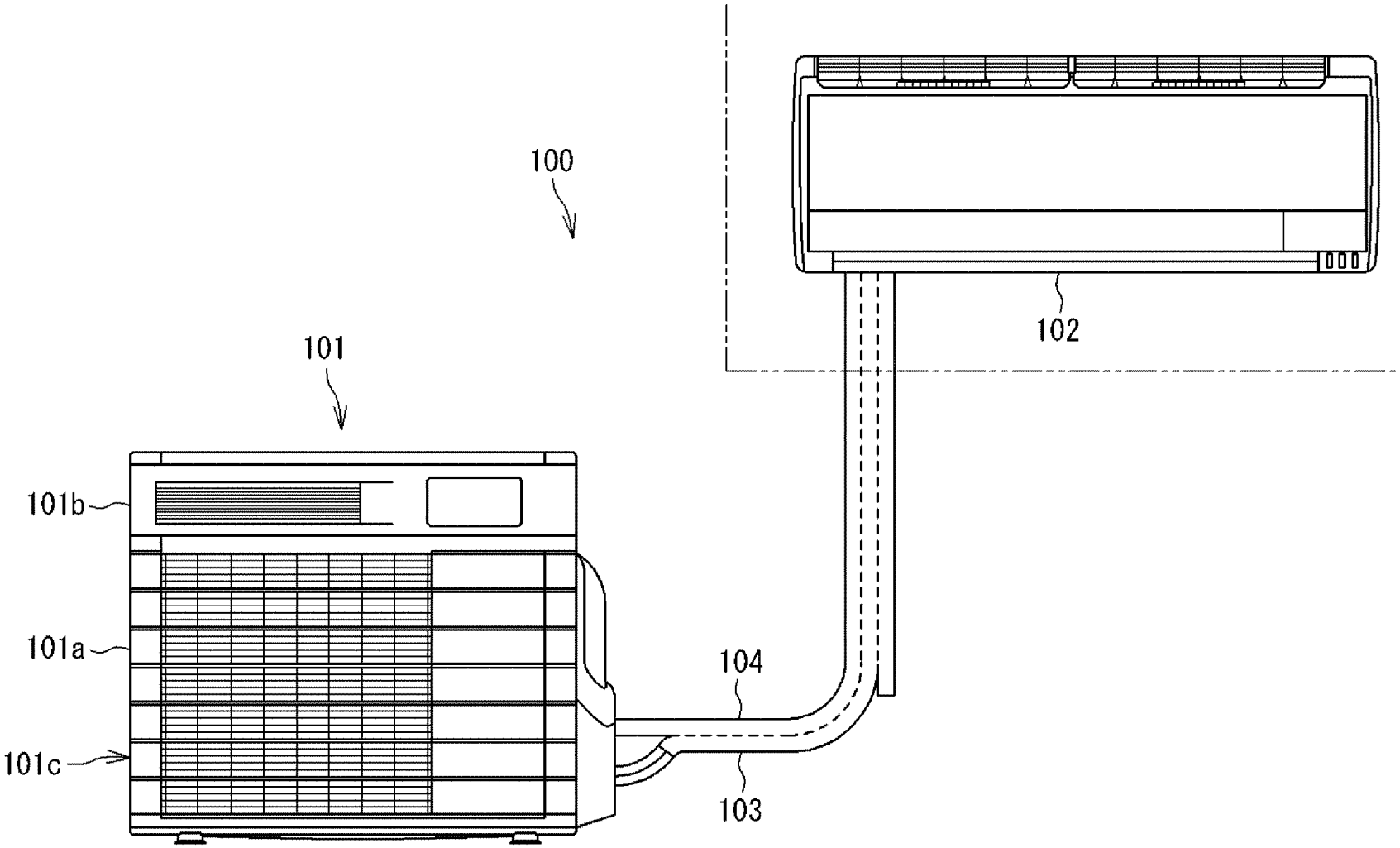
FIG. 1 is a diagram depicting exemplary outer appearance of an air conditioner.

FIG. 1 is a diagram depicting exemplary outer appearance of an air conditioner 100. The air conditioner 100 includes an outdoor unit 101 and an indoor unit 102. The outdoor unit 101 includes a case 101*c* constituted by a body unit 101*a* having a built-in refrigerant circuit, and a ventilating-humidifying unit 101*b* provided thereon. The case 101*c* mentioned herein corresponds to an outer package portion having maximum size of the outdoor unit 101, and does not matter whether or not to have an internal partition. The outdoor unit 101 and the indoor unit 102 are connected via a refrigerant pipe 103 and an air pipe 104.

Functional Schematic View of Air Conditioner

Figure 2:
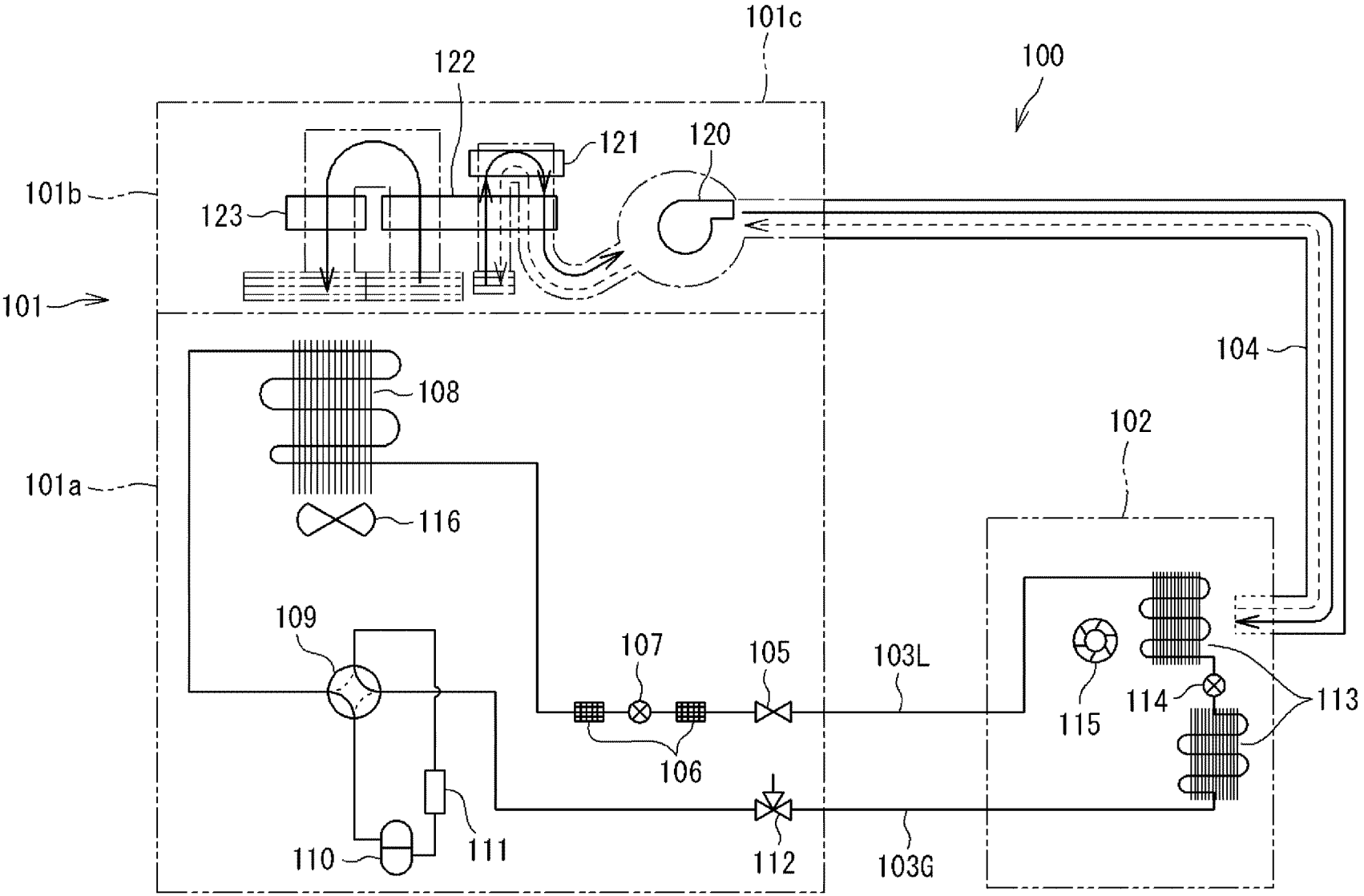
FIG. 2 is a functional schematic view of the air conditioner.

FIG. 2 is a functional schematic view of the air conditioner 100. The body unit 101*a* of the outdoor unit 101 includes, in the mentioned order, a liquid shutoff valve 105, a filter 106, an expansion valve 107, a heat exchanger 108, a four-way switching valve 109, a compressor 110, an accumulator 111, and a gas shutoff valve 112, which constitute a known refrigerant circuit connected as depicted. The heat exchanger 108 is provided with a fan 116 for ventilation.

The indoor unit 102 includes a heat exchanger 113, an expansion valve 114, and a fan 115, which are connected as depicted. The outdoor unit 101 and the indoor unit 102 are connected to each other via a liquid refrigerant tube 103L and a gas refrigerant tube 103G.

The ventilating-humidifying unit 101*b* includes an intake-exhaust fan 120, a heater 121, a humidifying rotor 122, and an adsorption fan 123. The ventilating-humidifying unit 101*b* is configured to discharge outdoors indoor air introduced into the indoor unit 102, and add moisture to fresh outdoor air and send indoors the air thus humidified. In winter, the ventilating-humidifying unit 101*b* is configured to introduce indoors air heated with use of the heater 121. The ventilating-humidifying unit 101*b* is connected with the indoor unit 102 via the air pipe 104.

The body unit 101*a* of the outdoor unit 101 operates in accordance with an own basic microcomputer to be described later. The ventilating-humidifying unit 101*b* operates in accordance with an own functional microcomputer to be described later.

Control Device

Figure 3:
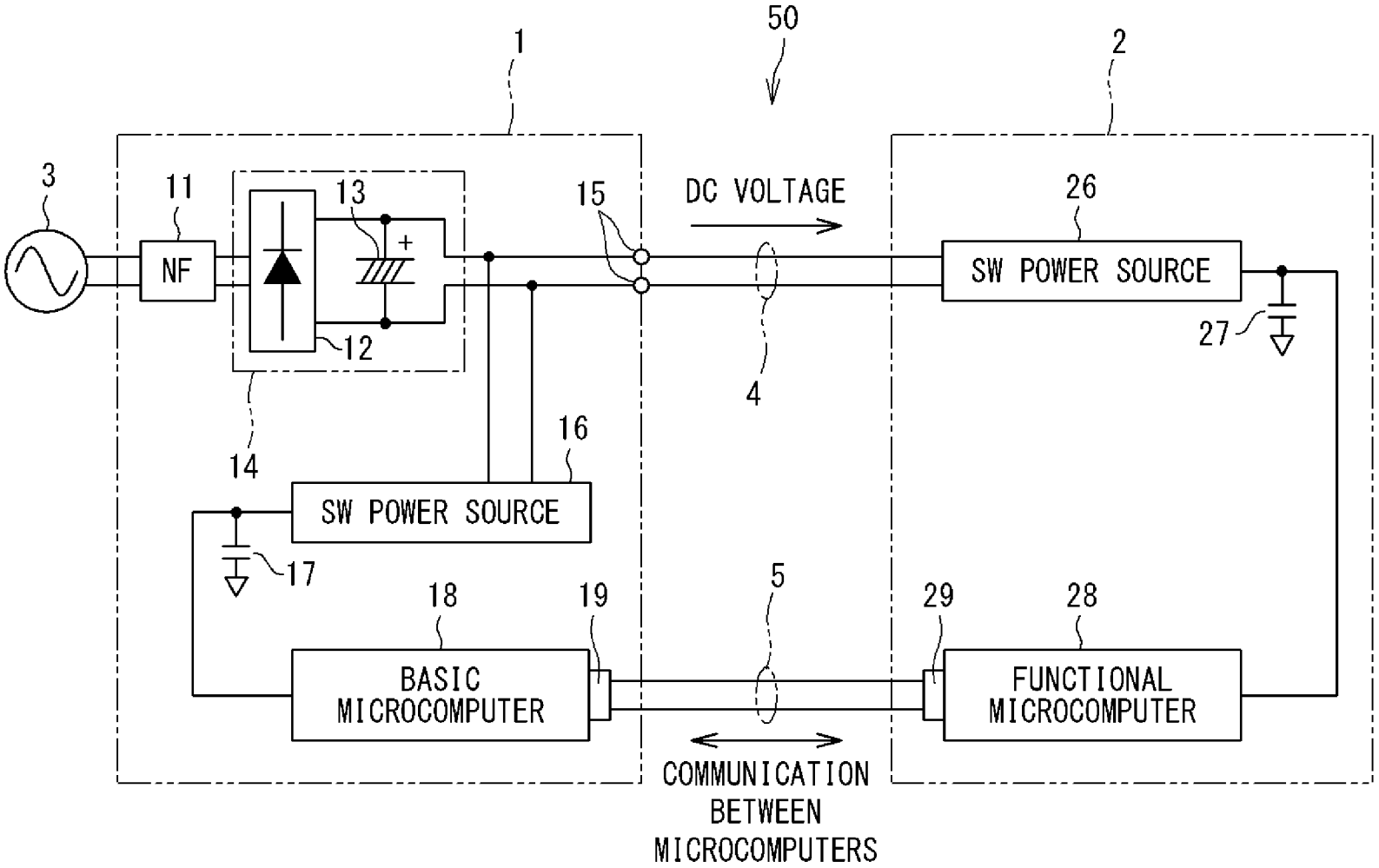
FIG. 3 is a circuit connection diagram depicting an exemplary center part of a control device in the air conditioner.

FIG. 3 is a circuit connection diagram depicting an exemplary center part of a control device 50 in the air conditioner 100. This figure depicts control boards each constituted by a printed circuit board. The control boards include a basic control board 1 (first control board) having a control function of achieving basic operation as the air conditioner 100, and a functional control board 2 (second control board) having a control function of achieving an additional function. The functional control board 2 is provided separately and is different from the basic control board 1. Though the figure depicts the single functional control board 2, there may occasionally be provided a plurality of functional control boards.

The basic control board 1 is connected with an external AC power source 3. The basic control board 1 is provided thereon with a noise filter 11, an AC-DC converter 14 including a rectifier circuit 12 and a smoothing capacitor 13, a terminal block 15 for external power supply, a switching power source 16, a capacitor 17, a basic microcomputer (first control unit) 18, and an interface circuit 19, which are connected as depicted.

The noise filter 11 inhibits noise leakage from the basic control board 1 to the AC power source 3. The AC-DC converter 14 rectifies by voltage doubling and smooths AC voltage (e.g. 100 V) to obtain DC voltage (about 280 V). Rectification by voltage doubling is merely exemplary, and the AC-DC converter has only to be a circuit configured to rectify and smooth AC voltage. This DC voltage is stepped down to predetermined voltage by the switching power source 16, for supply of stable control voltage to the basic microcomputer 18. The basic microcomputer 18 achieves basic operation as the air conditioner 100 in accordance with software. The software is stored in a memory (not depicted) equipped in the basic microcomputer 18.

The functional control board 2 is connected with the basic control board 1 via DC output wiring 4. The DC output wiring 4 supplies the functional control board 2 with DC voltage. The functional control board 2 is provided thereon with a switching power source 26, a capacitor 27, a functional microcomputer (second control unit) 28, and an interface circuit 29, which are connected as depicted.

The DC voltage supplied from the DC output wiring 4 is stepped down to predetermined voltage by the switching power source 26, for supply of stable control voltage to the functional microcomputer 28. The functional microcomputer 28 achieves additional functional operation as the air conditioner 100 in accordance with software. The software is stored in a memory (not depicted) equipped in the functional microcomputer 28. The basic microcomputer 18 and the functional microcomputer 28 are connected to each other via the interface circuit 19, a transmission line 5, and the interface circuit 29, to execute communication between microcomputers. The functional control board 2 is configured to control a function of ventilation, humidification, washing, or the like, independently from the basic control board 1.

The control device 50 depicted in FIG. 3 separately includes the basic control board 1 for achievement of basic functions and the functional control board 2 for achievement of additional functions, so as to prepare various additional functions by the functional control board 2. The functional control board 2 needs neither a noise filter nor an AC-DC converter, so as to achieve reduction in the number of components relevant to a power source circuit.

The basic control board 1 and the functional control board 2 are both accommodated in the common case 101*c* (FIG. 1). The both control boards 1 and 2 accommodated in the common case are disposed relatively close to each other, so as to inhibit noise generated on a communication circuit (the interface circuit 19, the transmission line 5, and the interface circuit 29) configured to execute communication between the basic microcomputer 18 and the functional microcomputer 28.

Communication Between Microcomputers

Figure 4:
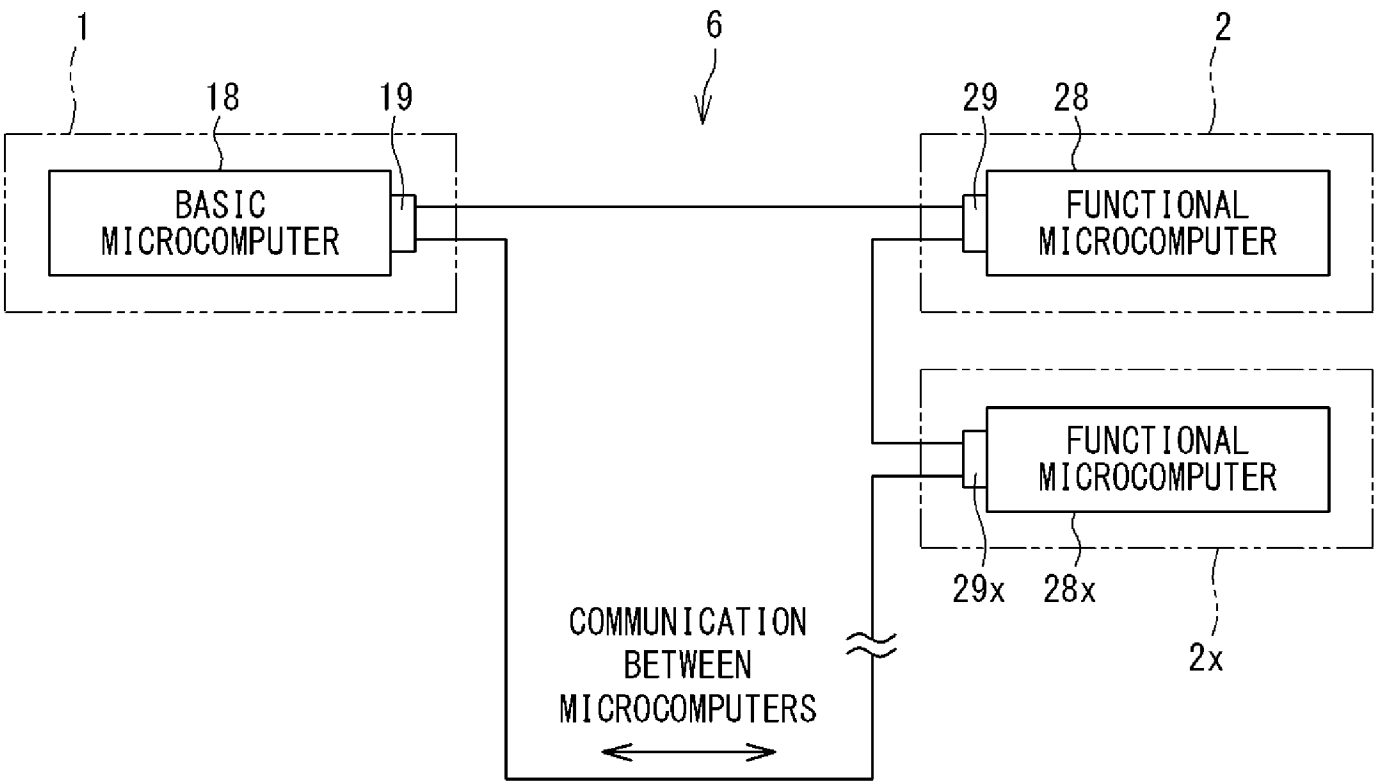
FIG. 4 is a circuit diagram depicting a communication circuit for communication between microcomputers.

Description is made next with focus on communication between microcomputers. FIG. 4 is a circuit diagram depicting a communication circuit 6 for communication between microcomputers. FIG. 3 exemplifies communication between the basic microcomputer 18 and the functional microcomputer 28 as one-to-one relation, whereas FIG. 4 depicts a case where there are provided two (exemplifying a plurality of) functional control boards. Similarly to the functional control board 2, an additional functional control board 2*x* includes a functional microcomputer 28*x* and an interface circuit 29*x*.

The communication circuit 6 is provided as a closed circuit configured to cause a current signal to flow in a time dividing manner. The communication circuit 6 constituted by the interface circuits 19, 29, and 29*x* is configured to cause electric current to flow in a looped manner. The microcomputers each have operation states including a normal mode of operating at high speed and a sleep mode of operating at low speed for functional inhibition and power saving.

Interface Circuit on Functional Control Board: First Example

Figure 5:
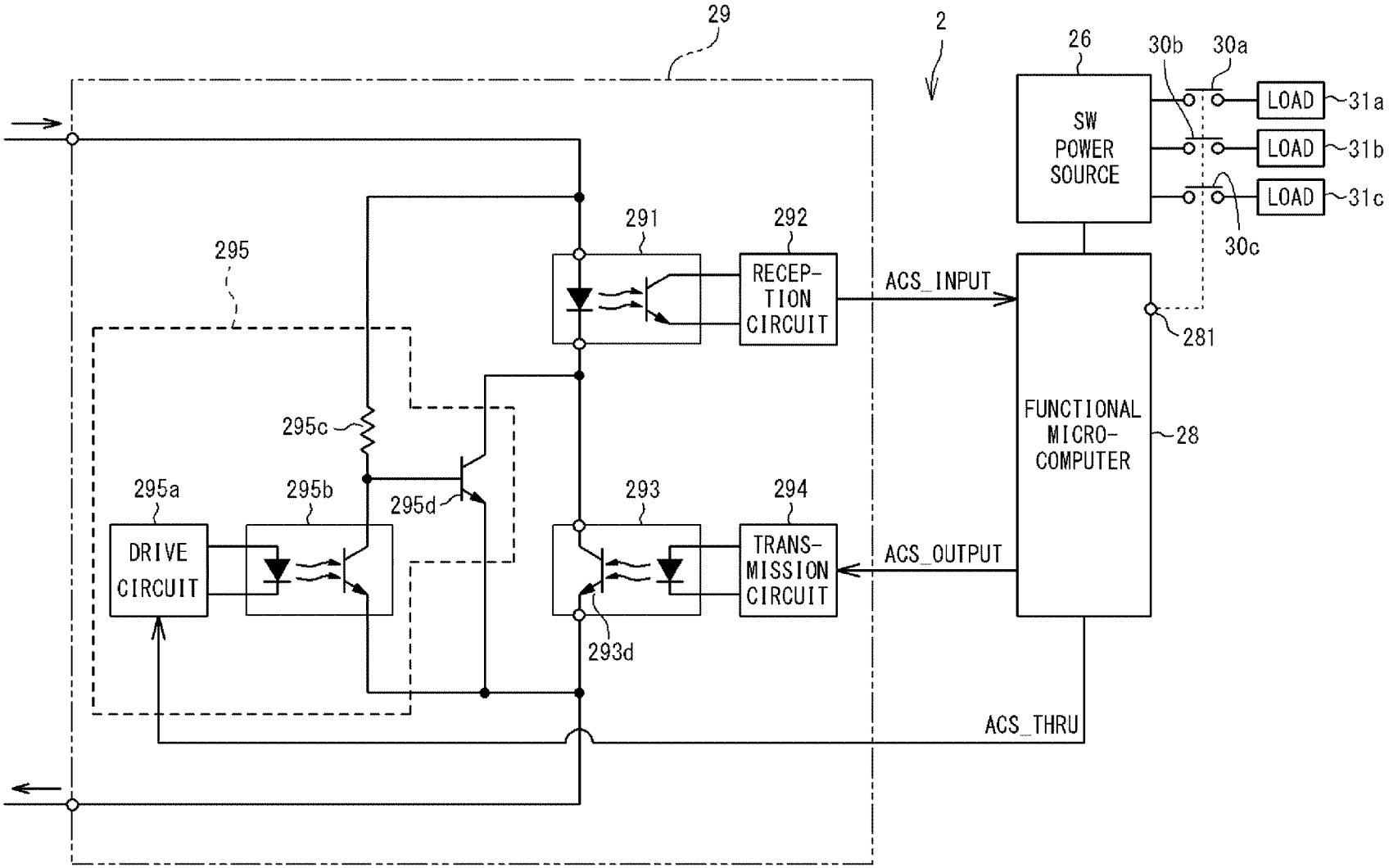
FIG. 5 is a circuit diagram depicting an interface circuit on a functional control board according to a first example.

FIG. 5 is a circuit diagram depicting the interface circuit 29 on the functional control board 2 according to the first example. In FIG. 5, the interface circuit 29 includes a photocoupler 291 functioning as an input unit for a signal transmitted from the basic microcomputer 18, a reception circuit 292, a photocoupler 293 functioning as an output unit for a signal to be transmitted to the basic microcomputer 18, a transmission circuit 294, and a bypass circuit (also called an ACS through circuit) 295. The bypass circuit 295 is configured to short-circuit and invalidate both ends of the output unit 293 in the sleep mode.

When a current signal flows to the photocoupler 291, an input signal ACS_INPUT is provided to the functional microcomputer 28 via the reception circuit 292. The functional microcomputer 28 outputs an output signal ACS_OUTPUT that turns ON or OFF the photocoupler 293 via the transmission circuit 294.

The bypass circuit 295 is constituted by a drive circuit 295*a*, a photocoupler 295*b*, resistance 295*c*, and a transistor 295*d*, which are connected as depicted. Examples of the resistance 295*c* has high resistance of about 24 kΩ. An ACS_THRU signal has an H level when the functional microcomputer 28 is in the normal mode (operating at high speed), and has an L level when the functional microcomputer 28 is in the sleep mode (operating at low speed).

When the ACS_THRU signal has the H level, the drive circuit 295*a* turns ON the photocoupler 295*b*. In this case, the transistor 295*d* is in an OFF state because the transistor 295*d* has no voltage generated between a base and an emitter, and the communication circuit 6 (FIG. 4) has electric current flowing through the photocoupler 293. In other words, the photocoupler 293 is ready to output a signal. In this case, the bypass circuit 295 has electric current flowing from the resistance 295*c* and passing the photocoupler 295*b*. The electric current is quite small because the resistance 295*c* has a high resistance value.

When the ACS_THRU signal has the L level, the drive circuit 295*a* turns OFF the photocoupler 295*b*. In this case, the transistor 295*d* is in an ON state because the transistor 295*d* has voltage applied between the base and the emitter via the resistance 295*c*. The photocoupler 293 is bypassed by the transistor 295*d* connected in parallel, and the photocoupler 293 includes a phototransistor 293*d* being short-circuited. The functional microcomputer 28 has an output port (a port for ACS_OUTPUT) thus invalidated.

The switching power source 26 supplies power to a device other than the functional microcomputer 28, and exemplarily supplies voltage of 5 V to a load 31*a* via a switch 30*a*. Similarly, the switching power source 26 supplies voltage of 14 V to a load 31*b* via a switch 30*b*, and supplies voltage of 15 V to a load 31*c* via a switch 30*c*. The functional microcomputer 28 is configured to control to turn ON or OFF the switches 30*a*, 30*b*, and 30*c* with use of an output port 281.

(Operation of Functional Microcomputer)

Figure 6:
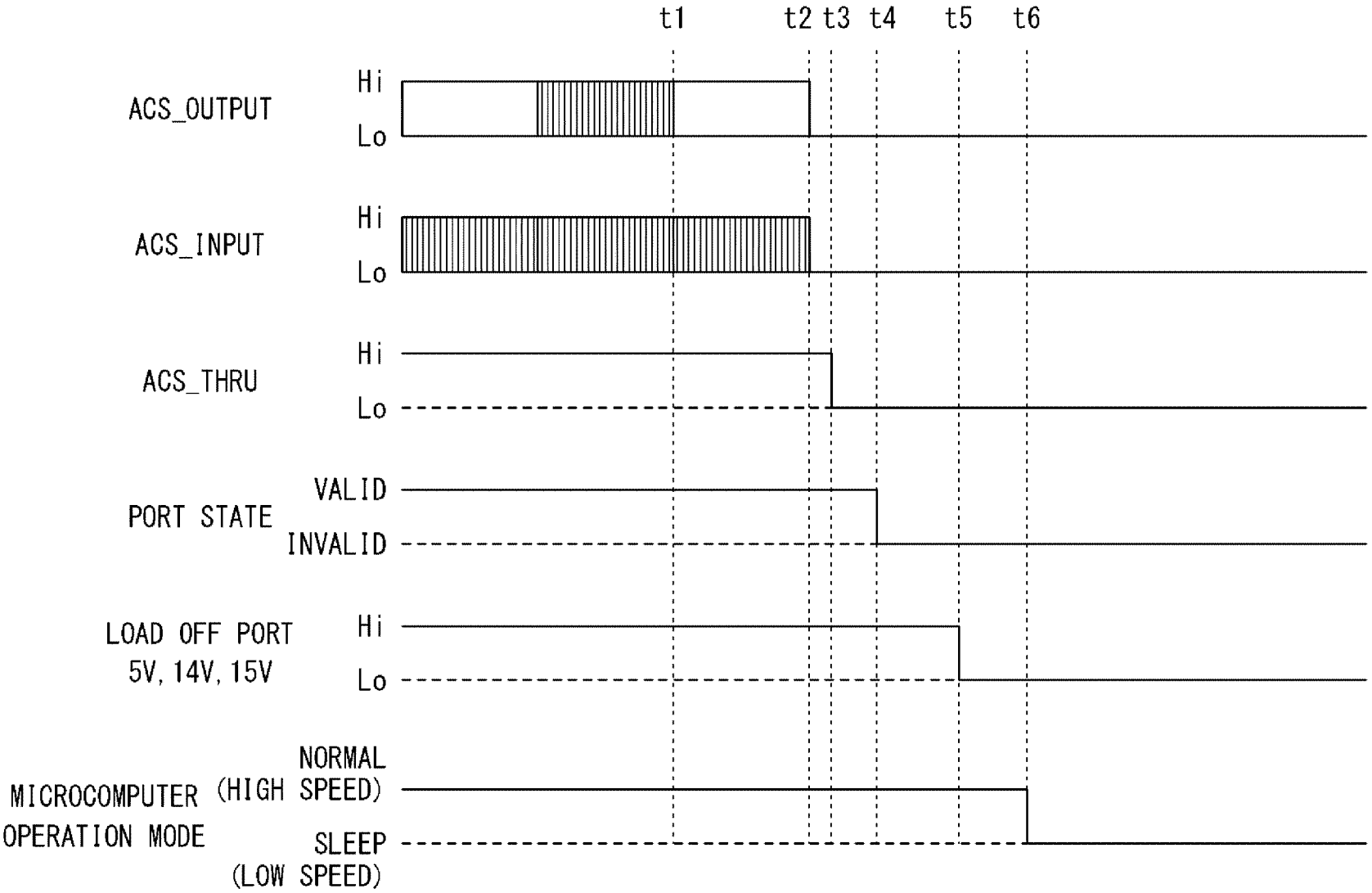
FIG. 6 is an exemplary timing chart in a case where a functional microcomputer comes into a sleep mode from a normal mode.

FIG. 6 is an exemplary timing chart in a case where the functional microcomputer 28 comes into the sleep mode from the normal mode. The timing chart indicates, in the mentioned order from the top, ACS_OUTPUT, ACS_INPUT, ACS_THRU, a port state, a load off port (5 V, 14 V, 15 V), and a microcomputer operation mode. The port state indicates whether the output port (the port for ACS_OUTPUT) is valid or invalid. When the port state is invalid, an input port is also invalid except for microcomputer reset and ACS_INPUT. The load off port corresponds to the output port 281.

In an initial state, communication is executed between the basic microcomputer 18 and the functional microcomputer 28. ACS_THRU has the H level, and the port for ACS_OUTPUT is valid. The load off port also has the H level, and the switches 30*a*, 30*b*, and 30*c* are closed. The microcomputer operation mode is the normal mode (high speed).

At time t1, a signal inquiring about authorization for switching into the sleep mode is transmitted from the functional microcomputer 28 to the basic microcomputer 18. At time t2, the basic microcomputer 18 transmits, to the functional microcomputer 28, a signal authorizing to switch into the sleep mode. Communication between microcomputers is stopped hereafter. At time t3, ACS_THRU changes to the L level. At time t4, the transistor 295*d* (FIG. 5) is turned ON, and the port state for ACS_OUTPUT becomes invalid. At time t5, the load off port has the L level, and power supply to the loads 31*a*, 31*b*, and 31*c* is also stopped. The functional microcomputer 28 having come into the sleep mode opens the switches 30*a*, 30*b*, and 30*c* so as to inhibit unnecessary power consumption. At time t6, the microcomputer operation mode changes to the sleep mode.

In this manner, when the function of the functional control board 2 is not in use, the transistor 295*d* (FIG. 5) is turned ON (closed) to form bypass wiring at an output unit of the functional microcomputer 28 in the sleep mode. The output unit is thus invalidated. The bypass wiring is formed to keep the communication circuit for communication between microcomputers by means of a current signal even in a case where there is another functional control board provided for an additional function. The resistance 295*c* provided in series on a positive potential side of the base of the transistor 295*d* has high resistance (e.g. 24 kΩ), so as to inhibit electric current flowing to the transistor 295*d* through the resistance 295*c* in the sleep mode.

The transistor 295*d* in FIG. 5 has ON resistance (electric resistance) less than ON resistance of the photocoupler 293. It is thus possible to inhibit electric current from flowing toward the photocoupler 293 and cause electric current to reliably flow to the transistor 295*d* on the bypass circuit 295.

Figure 7:
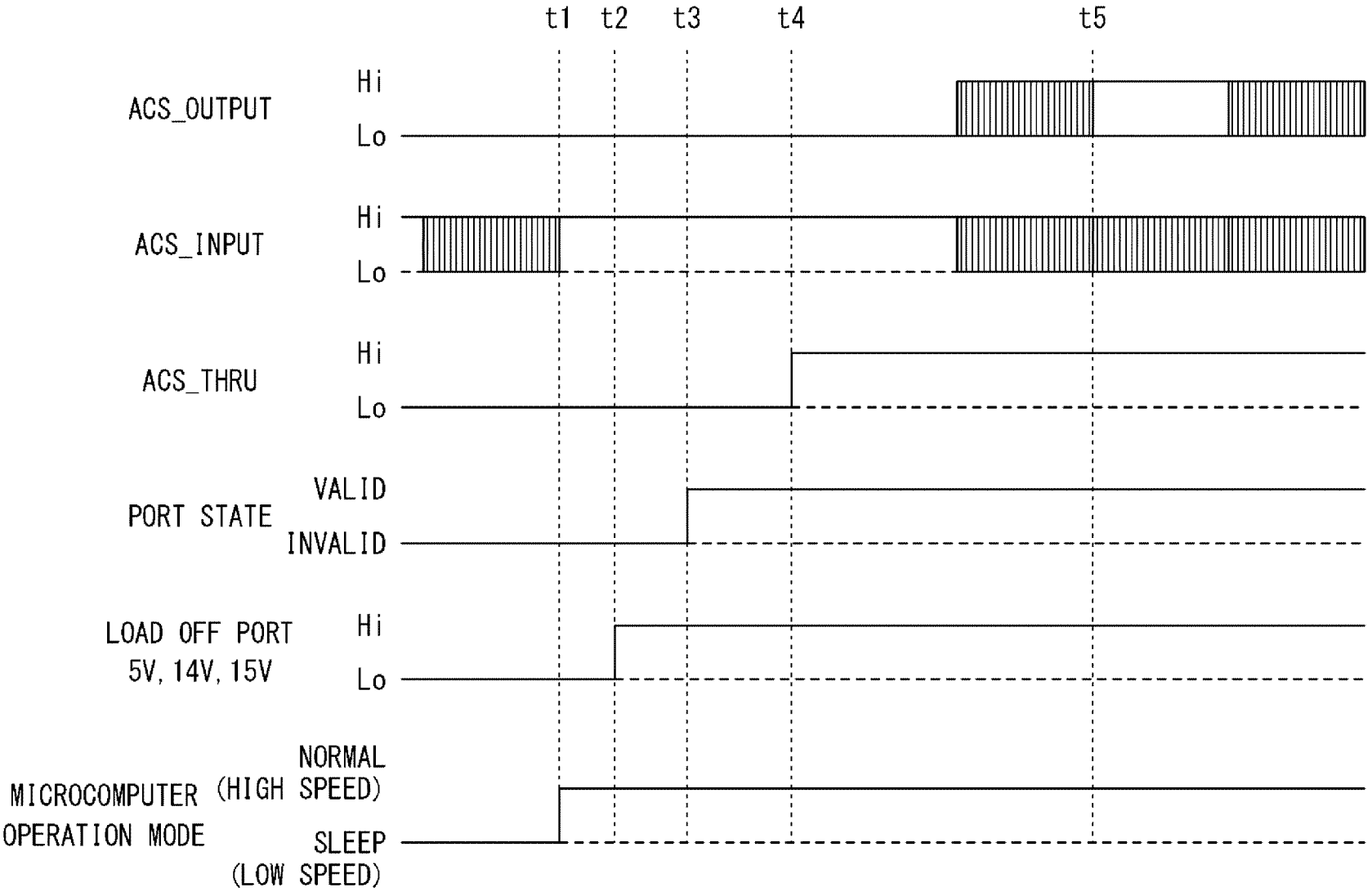
FIG. 7 is an exemplary timing chart in a case where the functional microcomputer returns into the normal mode from the sleep mode.

FIG. 7 is an exemplary timing chart in a case where the functional microcomputer 28 returns into the normal mode from the sleep mode. Similarly to FIG. 5, the timing chart indicates, in the mentioned order from the top, ACS_OUTPUT, ACS_INPUT, ACS_THRU, the port state, the load off port, and the microcomputer operation mode.

The basic microcomputer 18 transmits a signal for cancellation of the sleep mode. At the time t1, the functional microcomputer 28 having received the signal for cancellation of the sleep mode changes the microcomputer operation mode from the sleep mode into the normal mode. At the time t2, the load off port changes to the H level, and power supply to the loads 31*a*, 31*b*, and 31*c* is enabled. At the time t3, the port state of the functional microcomputer 28 becomes valid. At the time t4, ACS_THRU reaches the H level. At the time t5, the functional microcomputer 28 notifies the basic microcomputer 18 of return into the normal mode, to enable communication between microcomputers hereafter.

Exemplifies below are variations of the interface circuit on the functional control board.

Interface Circuit on Functional Control Board: Second Example

Figure 8:
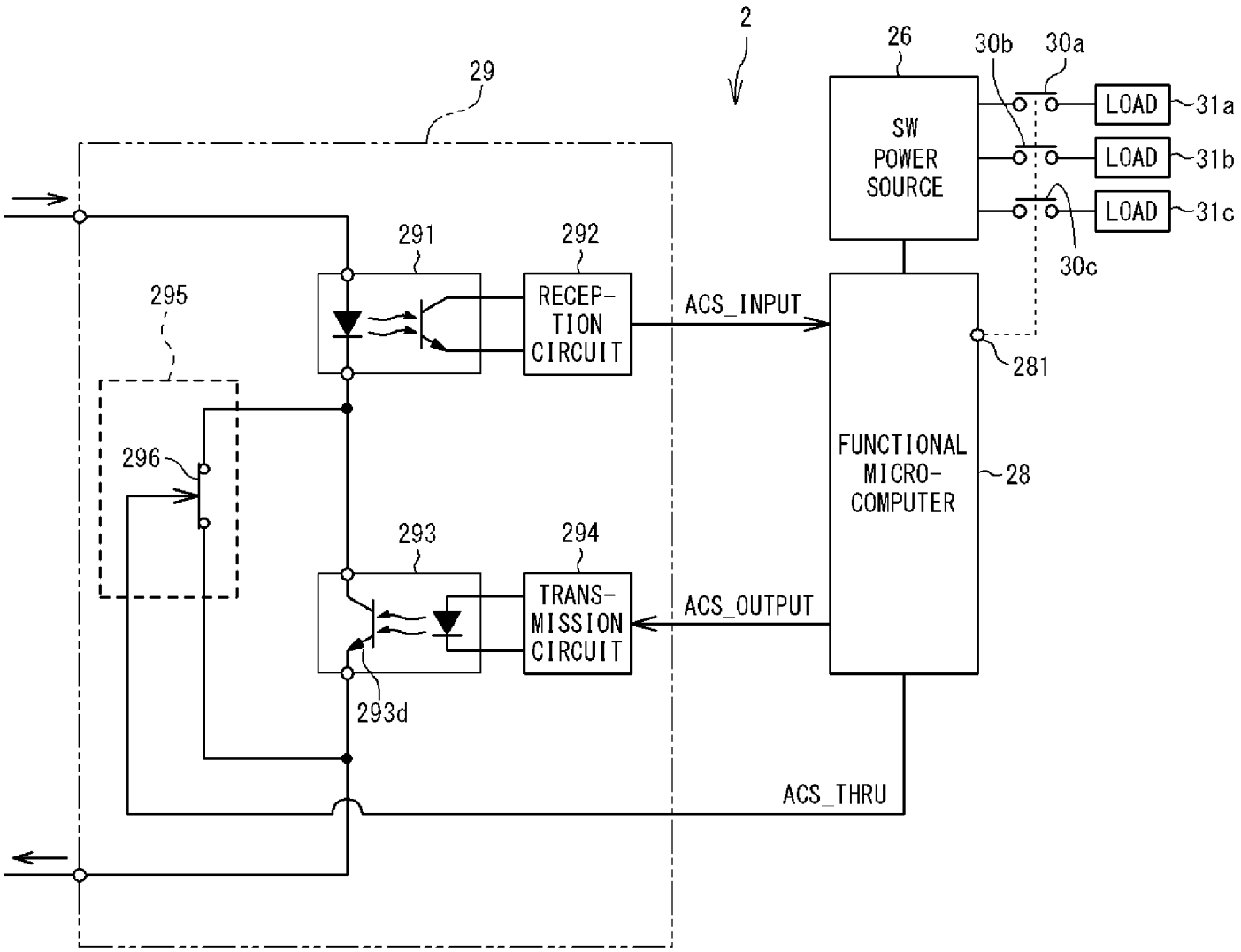
FIG. 8 is a circuit diagram depicting the interface circuit on the functional control board according to a second example.

FIG. 8 is a circuit diagram depicting the interface circuit 29 on the functional control board 2 according to the second example. This circuit diagram can be regarded as depicting a basic circuit obtained by further simplifying the circuit depicted in FIG. 5. The circuit configurations other than a switch 296 are similar to circuit configurations on the circuit depicted in FIG. 5, and are thus denoted by the identical reference signs and will not be described repeatedly. The switch 296 is opened when ACS_THRU has the H level, and is closed when ACS_THRU has the L level to short-circuit the phototransistor 293*d* of the photocoupler 293 and invalidate ACS_OUTPUT. Examples of the switch 296 include a semiconductor switch, as well as a relay. Electric resistance is smaller when the switch 296 is constituted by the relay in comparison to the case where the switch 296 is constituted by the semiconductor switch, to inhibit attenuation in signal level of the communication circuit 6 (FIG. 4).

Interface Circuit on Functional Control Board: Third Example

Figure 9:
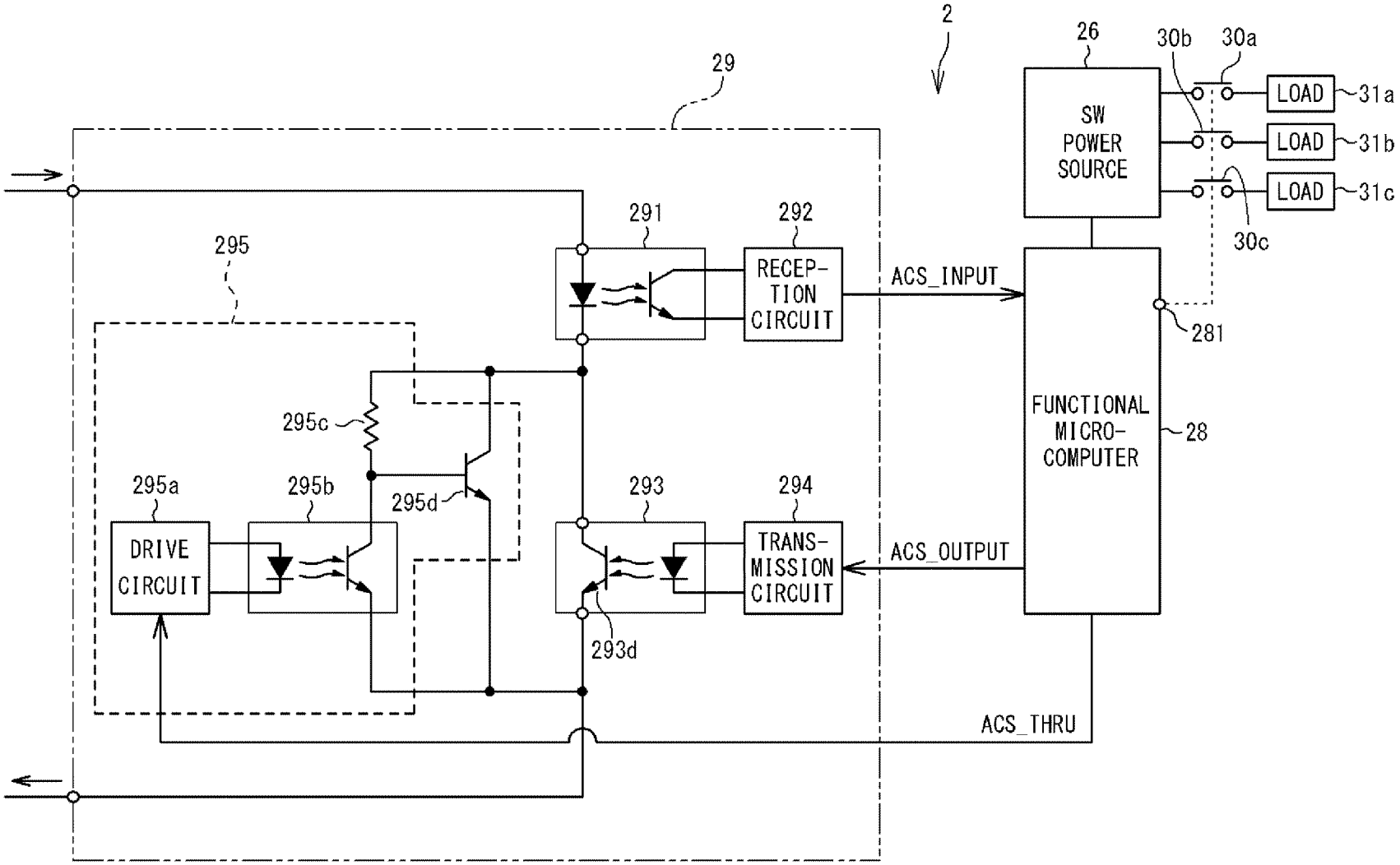
FIG. 9 is a circuit diagram depicting the interface circuit on the functional control board according to a third example.

FIG. 9 is a circuit diagram depicting the interface circuit 29 on the functional control board 2 according to the third example. The circuit includes the same constituent components of the circuit depicted in FIG. 5, and the respective constituent components are thus denoted by the identical reference signs and will not be described repeatedly. FIG. 9 is different from FIG. 5 in that the photocoupler 291 has an anode connected with a collector of the transistor 295*d* and the resistance 295*c*. The bypass circuit 295 operates similarly to the case depicted in FIG. 5.

Interface Circuit on Functional Control Board: Fourth Example

Figure 10:
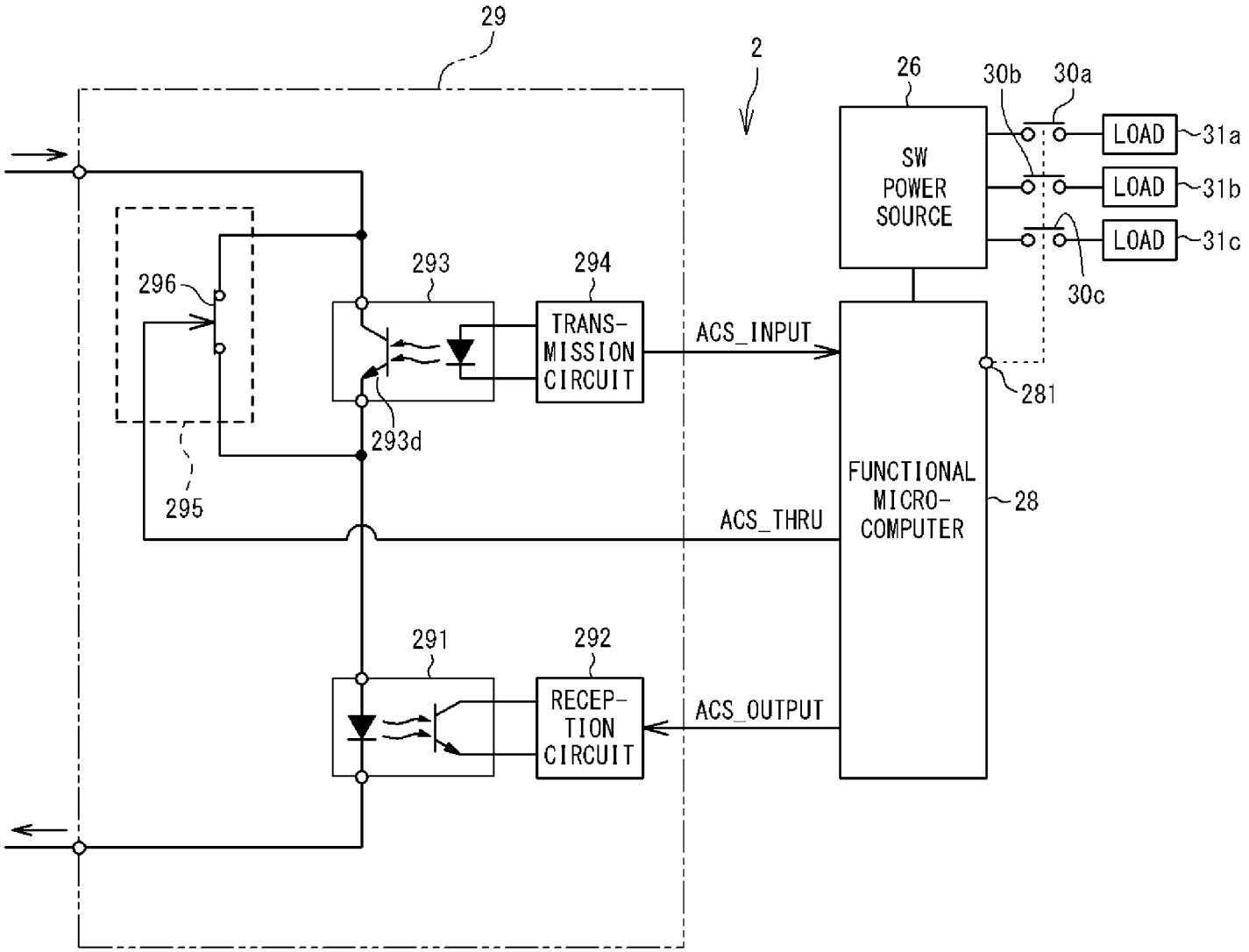
FIG. 10 is a circuit diagram depicting the interface circuit on the functional control board according to a fourth example.

FIG. 10 is a circuit diagram depicting the interface circuit 29 on the functional control board 2 according to the fourth example. The circuit includes the same constituent components of the circuit depicted in FIG. 8, and the respective constituent components are thus denoted by the identical reference signs and will not be described repeatedly. FIG. 10 is different from FIG. 8 in that the photocoupler 291 and the photocoupler 293 are inverted in vertical relation, but the circuit depicted in FIG. 10 operates similarly to the circuit depicted in FIG. 8.

At least part of the interface circuits according to the above examples may be appropriately combined with each other. The interface circuit can have other variations. In short, the interface circuit has only to constitute a bypass circuit configured to validate and invalidate ACS_OUTPUT for the functional microcomputer.

Summary of Disclosure

The above disclosure can be expressed generally as follows.

This control device 50 includes the first control board (basic control board 1) connected with the AC power source 3 and equipped with the first control unit (basic microcomputer 18), and the second control board (functional control board 2) provided separately and different from the first control board 1 and equipped with the second control unit (functional microcomputer 28). The first control board includes the noise filter 11, the AC-DC converter 14 configured to generate DC voltage from supplied AC voltage, and the DC output wiring 4 configured to allow the DC voltage to be used in the board and also supply the DC voltage to outside the board. The second control board is supplied with the DC voltage from the DC output wiring 4.

In an exemplary case where the control device 50 thus configured includes the first control board for achievement of the basic functions of the device and the second control board for achievement of the additional functions of the device, the second control board can achieve various additional functions. The second control board needs neither a noise filter nor an AC-DC converter, so as to achieve reduction in the number of components relevant to a power source circuit. Accordingly, the number of components can be reduced even in a case where a single apparatus is equipped with a plurality of control boards.

The first control board and the second control board are preferably accommodated in the common case.

The first control board and the second control board accommodated in the common case are disposed relatively close to each other, so as to inhibit noise generated on the communication circuit configured to execute communication between the first control unit and the second control unit. The case mentioned herein corresponds to an outer package portion having maximum size of the device, and does not matter whether or not to have an internal partition.

The second control board includes the communication circuit configured to execute communication between the first control unit and the second control unit by means of a current signal. The communication circuit includes the input unit configured to provide an input signal from the first control board to the second control unit, the output unit connected in series to the input unit and configured to output an output signal from the second control unit to the first control board, and the bypass circuit 295 provided in parallel with the output unit and including the first switch (295*d*, 296). The second control unit closes the first switch when coming into the sleep mode, and opens the first switch when cancelling the sleep mode.

In this case, when the function of the second control board is not in use, the first switch is closed to form the bypass circuit configured to invalidate the output unit of the second control unit in the sleep mode. The bypass circuit is formed to keep the communication circuit by means of a current signal even in a case where there is another control board provided for an additional function and configured similarly to the second control board.

The first switch is the semiconductor switch, and the resistance is connected in series on the positive potential side from a control terminal. This case enables inhibition of control current flowing to the semiconductor switch.

The first switch being closed has electric resistance preferably less than electric resistance of the output unit. In this case, it is possible to inhibit electric current from flowing toward the output unit and cause electric current to reliably flow to the bypass circuit.

The second control unit (functional microcomputer 28) is configured to control the function of ventilation, humidification, or washing. Such a function can be achieved by the second control unit independently from the first control unit. The second control unit is not limitedly configured to achieve the above function, but may alternatively be configured to control a plurality of indoor units provided in multiple connection. The second control unit may be configured to control a hot water supply apparatus connected to the outdoor unit. When the outdoor unit is equipped with two or more fans, the second control unit may be configured to control a second and subsequent fans.

The second control board includes the switching power source 26 to be supplied with DC voltage, and the switching power source 26 has an output side provided with the second switch (30*a*, 30*b*, 30*c*).

When the second control unit comes into the sleep mode, the second control board opens the second switch so as to inhibit unnecessary power consumption.

The air conditioner includes the control device according to any one described above.

Supplementary Note

The embodiment has been described above. Various modifications to modes and details should be available without departing from the object and the scope of the claims.

REFERENCE SIGNS LIST

1 basic control board (first control board)
2 functional control board (second control board)
3 AC power source
4 DC output wiring
5 transmission line
6 communication circuit
11 noise filter
12 rectifier circuit
13 smoothing capacitor
14 AC-DC converter
15 terminal block
16 switching power source
17 capacitor
18 basic microcomputer (first control unit)
19 interface circuit
26 switching power source
27 capacitor
28 functional microcomputer (second control unit)
29, 29*x* interface circuit
30*a*, 30*b*, 30*c* switch (second switch)
31*a*, 31*b*, 31*c* load
50 control device
100 air conditioner
101 outdoor unit
101*a* body unit
101*b* ventilating-humidifying unit
101*c* case
102 indoor unit
103 refrigerant pipe
103L liquid refrigerant tube
103G gas refrigerant tube
104 air pipe
105 liquid shutoff valve
106 filter
107 expansion valve
108 heat exchanger
109 four-way switching valve
110 compressor
111 accumulator
112 gas shutoff valve
113 heat exchanger
114 expansion valve
115 fan
116 fan
120 fan
121 heater
122 humidifying rotor
123 adsorption fan
281 output port (load off port)
291 photocoupler (input unit)
292 reception circuit
293 photocoupler (output unit)
293*d* phototransistor
294 transmission circuit
295 bypass circuit
295*a* drive circuit
295*b* photocoupler
295*c* resistance
295*d* transistor (first switch)
296 switch (first switch)

The invention claimed is:

1. A control device comprising:

a first control board connected with an AC power source and equipped with a first control unit; and a second control board provided separately and different from the first control board and equipped with a second control unit; wherein the first control board includes a noise filter, an AC-DC converter configured to generate DC voltage from AC voltage, and DC output wiring configured to allow the DC voltage to be used in the board and also supply the DC voltage to outside the board, and the second control board is supplied with the DC voltage from the DC output wiring.

2. The control device according to claim 1, wherein the first control board and the second control board are accommodated in a common case.

3. The control device according to claim 1, wherein the second control unit controls a function of ventilation, humidification, or washing.

4. The control device according to claim 1, wherein the second control board includes a switching power source to be supplied with the DC voltage, and the switching power source has an output side provided with a second switch.

5. An air conditioner comprising the control device according to claim 1.

6. A control device comprising:

a first control board connected with an AC power source and equipped with a first control unit; and a second control board provided separately and different from the first control board and equipped with a second control unit; wherein the first control board includes a noise filter, an AC-DC converter configured to generate DC voltage from AC voltage, and DC output wiring configured to allow the DC voltage to be used in the board and also supply the DC voltage to outside the board, and the second control board is supplied with the DC voltage from the DC output wiring, wherein the second control board includes a communication circuit configured to execute communication between the first control unit and the second control unit by means of a current signal, and the communication circuit includes an input unit configured to provide an input signal from the first control board to the second control unit, an output unit connected in series to the input unit and configured to output an output signal from the second control unit to the first control board, and a bypass circuit provided in parallel with the output unit and including a first switch, and the second control unit closes the first switch when coming into a sleep mode and opens the first switch when cancelling the sleep mode.

7. The control device according to claim 6, wherein the first switch is a semiconductor switch, and resistance is connected in series on a positive potential side from a control terminal.

8. The control device according to claim 6, wherein, when the first switch is closed, electric resistance is less than electric resistance of the output unit.

9. The control device according to claim 6, wherein the first control board and the second control board are accommodated in a common case.

10. An air conditioner comprising the control device according to claim 6.

11. The control device according to claim 6, wherein the second control unit controls a function of ventilation, humidification, or washing.

12. The control device according to claim 6, wherein the second control board includes a switching power source to be supplied with the DC voltage, and the switching power source has an output side provided with a second switch.

13. The control device according to claim 6, wherein the bypass circuit is configured to invalidate the output unit in the sleep mode.

14. The control device according to claim 6, wherein the bypass circuit is configured to short-circuit both ends of the output unit in the sleep mode.

15. The control device according to claim 6, wherein the first switch is configured to short-circuit both ends of the output unit when the first switch is closed.

* * * * *